US005427879A

United States Patent [19]

Takano et al.

[11] Patent Number: 5,427,879

[45] Date of Patent: Jun. 27, 1995

[54] ELECTROPHOTOGRAPHIC PHOTORECEPTORS

[75] Inventors: Shigemasa Takano; Naoyuki Matsui; Tomoko Noguchi; Tomoyuki Yoshii, all of Tokyo, Japan

[73] Assignee: NEC Corporation, Tokyo, Japan

[21] Appl. No.: 107,600

[22] Filed: Aug. 18, 1993

[30] Foreign Application Priority Data

Aug. 18, 1992 [JP] Japan ..... 4-219074

[51] Int. Cl.[6] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 4,727,009 | 2/1988 | Takai et al. | 430/59 X |
| 4,758,488 | 7/1988 | Johnson et al. | 430/59 |
| 4,839,252 | 6/1989 | Murata et al. | 430/59 |
| 4,971,875 | 11/1990 | Gregory et al. | 430/59 |

FOREIGN PATENT DOCUMENTS

| | | | |
|---|---|---|---|
| 125941 | 8/1982 | Japan | 430/59 |
| 58550 | 4/1983 | Japan | 430/59 |
| 1-35449 | 2/1989 | Japan . | |
| 1-285949 | 11/1989 | Japan . | |
| 3-33751 | 2/1991 | Japan . | |
| 107563 | 4/1992 | Japan | 430/59 |
| 4-195055 | 7/1992 | Japan . | |

OTHER PUBLICATIONS

"Guiding Concept for Developing Better Charge Transporting Organic Materials", *Electrophotography,* vol. 25, No. 3, 1986, By R. Takahashi et al., pp. 236–242.

"New Double Layered Photoconductors for Electrophotography", *1979 Printing Reprography Testing Conference Proceedings,* Nov. 11–14, 1979, By A. Kakuta et al., pp. 149–156.

*Primary Examiner*—Roland Martin

*Attorney, Agent, or Firm*—Young & Thompson

[57] ABSTRACT

An electropotographic photoreceptor has a charge-transfer layer including at least two of charge-transfer materials, difference in oxidation potential between the charge-transfer materials being 0.1V or less and the charge-transfer materials having chemical structure similar to each other.

16 Claims, 11 Drawing Sheets

CHANGE IN MOBILITY TO EACH MIXING RATIO IN TWO-COMPONENT SYSTEM

CTM/Resin=0.8/1

CTM : CT-3/CT-1/CT-2 = X/Y/1 (FIXED)

CHANGE IN MOBILITY TO MIXING RATIO IN THREE-COMPONENT SYSTEM

CHANGE IN MOBILITY TO EACH MIXING RATIO IN TWO-COMPONENT SYSTEM

CHANGE IN MOBILITY TO MIXING RATIO IN THREE-COMPONENT SYSTEM

CTM/Resin = 0.8/1

CHANGE IN MOBILITY TO MIXING RATIO IN TWO-COMPONENT SYSTEM

EXPOSURE CHARACTERISTICS
(NORMAL TEMPERATURES AND HUMIDITY)

CHARGE POTENTIAL-TEMPERATURE AND RELATIVE HUMIDITY CHARACTERISTICS

IMAGE POTENTIAL-TEMPERATURE AND RELATIVE HUMIDITY CHARACTERISTICS
(ENERGY DENSITY=0.5 μJ/cm²)

ELECTROPHOTOGRAPHIC PHOTORECEPTORS

BACKGROUND OF THE INVENTION

1. Field of the Invention

This invention relates to an electrophotographic photoreceptor having excellent function and in particular to an electrophotographic photoreceptor having better photoresponse characteristics, better stability during cycle operation and better resistance to environment.

2. Disclosure of the Related Art

With development-b of non-impact printer technology in recent years, the research development on electrophotographic printers using laser beam sources has been practiced actively. In these apparatuses, reduction in size and speeding-up of the apparatuses have been required and in addition photosensitive materials having high photosensitivity and high speed photoresponse have been required. In electrophotographic photoreceptors using conventional charge-transfer materials for a charge-transfer layer, however, there could not have been still obtained sufficient characteristics. Namely, the photoreceptors had a high residual potential and dark decay and were bad in stability during cycle operation or repeated use. In addition, it is necessary for the photoreceptor to have stable characteristics in a desired range of temperature and relative humidity in a practical application and further stable characteristics have been desired for the photoreceptor.

With respect to the high-speed photoresponse characteristics as mentioned above, the improvement thereof has been tried by developing new materials for the charge-transfer layer having high mobility or increasing the density or ratio of the charge-transfer material in the charge-transfer layer, to thereby improve the photoresponse characteristics. However, it was difficult to develop the new desired materials. Furthermore, since the density of the charge-transfer material in the charge-transfer layer is uniform in a three-dimensional direction in a uniformly dispersed system of the charge-transfer material in a bonding resin, the mobility is proportional to 3rd root of an average intermolecular distance (Leading Concept for Developing Better Charge Transportable Organic Materials; R. Takahashi et al., Electrophotography, Vol. 25, No. 3, 10(1986)). For this reason, even if the density of the charge-transfer material in the bonding resin was increased, the mobility was slightly improved or rather there was a problem in the practical use that strength of the film was deteriorated.

In view of the above-mentioned problem, it has been proposed to conveniently combine two or more of the charge-transfer materials each having specific features. For instance, in order to adjust the mobility and the stability during cycle operation, it has been known to combine two charge-transfer materials, i.e. a butadiene series compound and a hydrazone compound as represented by CT-1 and CT-2, respectively, in Table 1 as mentioned below (refer to U.S. Pat. No. 4,839,252). However, this prior art sacrifices the good mobility of the butadiene series compound for the stability during cycle operation.

As described above, remarkable improvement in performance of the photoreceptor could not have been achieved by using the known compounds and any combination thereof on the basis of the known methods and further it was difficult to develop the new materials. Under the circumstances, it is very important to make the best use of the characteristics of the known charge-transfer materials.

SUMMARY OF THE INVENTION

Accordingly, an object of this invention is to provide an electrophotographic photoreceptor which makes it possible to improve mobility and depress rising of residual potential and which has excellent photoresponse characteristics, excellent stability during cycle operation and excellent environmental resistance, without increasing the density or ratio of charge-transfer materials in a charge-transfer layer.

According to this invention, there is provided an electrophotographic photoreceptor comprising a photoconductive supporting member, and at least a charge-generating layer and a charge-transfer layer which are disposed on the supporting member, in which the charge-transfer layer contains at least two of charge-transfer materials and difference in oxidation potential between the charge-transfer materials is of 0.1 V or less.

The foregoing and other objects and features of this invention will be apparent from the following description.

DETAILED DESCRIPTION OF THE PREFERRED EMBODIMENTS

An electrophotographic photoreceptor according to this invention includes at least a charge-generating layer and a change-transfer layer on a photoconductive supporting member. The change-transfer layer includes two or more of charge-transfer materials with difference in oxidation potential therebetween being 0.1 V or less.

In general, a charge-transfer layer is made of a bonding resin and charge-transfer materials having charge-transfer function, the materials being molten and dispersed in the bonding resin. The function is dependent mainly on characteristics of the charge-transfer materials. It is believed that hall mobility between the charge-transfer materials is foundationally based on transfer of a cation radical state of molecule. For this reason, the ease of the transfer and the level of conduction can be estimated on the basis of oxidation potential or ionization potential of the materials. It is considered that the ionization potential and the oxidation potential are correlated with each other and therefore the both potentials are the same meaning in this respect (A. Kakuta et al., TAPPI Printing Reprography Testing Conf. Prog., p. 149, Rochester N.Y., 1979). Thus, the charge-transfer material would be evaluated in terms of the oxidation potential herein.

In general, a charge-transfer material having low oxidation potential has high mobility and low residual potential but has large dark decay and poor stability in repeated use. On the other hand, a charge-transfer material having high oxidation potential is apt to give the opposite characteristics. For this reason, these materials are used as a mixture with an appropriate ratio according to the application to adjust the characteristics. The characteristics change dependent on the mixing ratio. Such a dependence is clear from data plotted in FIG. 7 as mentioned below.

Figure 1:
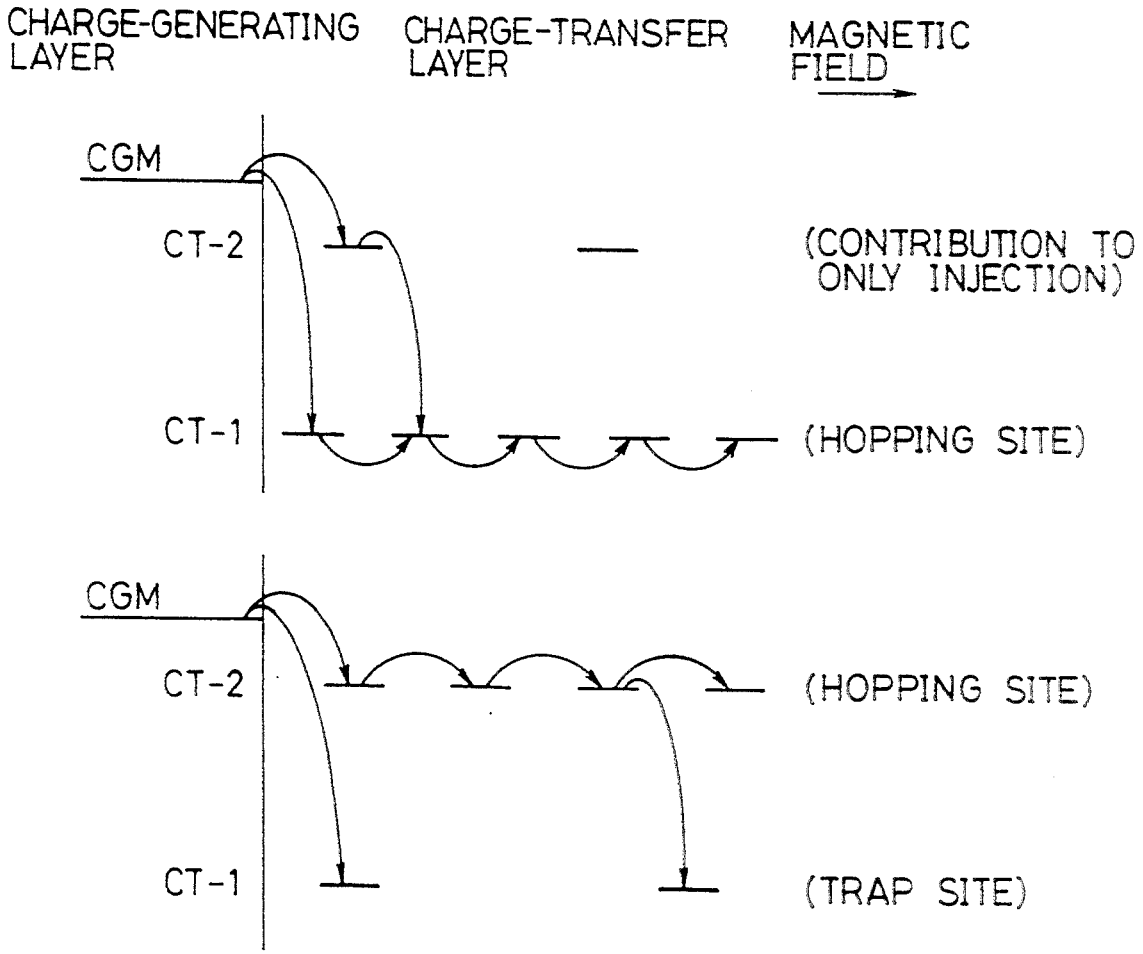
FIG.1 PRIOR ART
FIG. 1 is a diagram showing a model for explaining charge-transfer mechanism in a conventional two-component system.

Charge-transfer mechanism in the two-component system is explained on the basis of a model as shown in FIG. 1 in which "CGM" means a charge-generating material. Carriers are transferred into the material having low oxidation potential (i.e. a place having low conductive level). Therefore, if the material having low oxidation potential is mixed in a low ratio, it functions as a trap and as a result the mobility is reduced. As the ratio of the material having low oxidation potential to be mixed increases, the material functions as a main site for conduction of the carrier whereas the material having high oxidation potential functions as an injecting site and thereafter the carrier will be transferred and conducted to a place having low conductive level. In this case, the mobility depends on the density of the material having low oxidation potential and the photoresponse characteristics of a photoreceptor is slightly improved by increment of the injected carrier. However, the material having high oxidation potential does not contribute to a hopping conduction.

Figure 2:
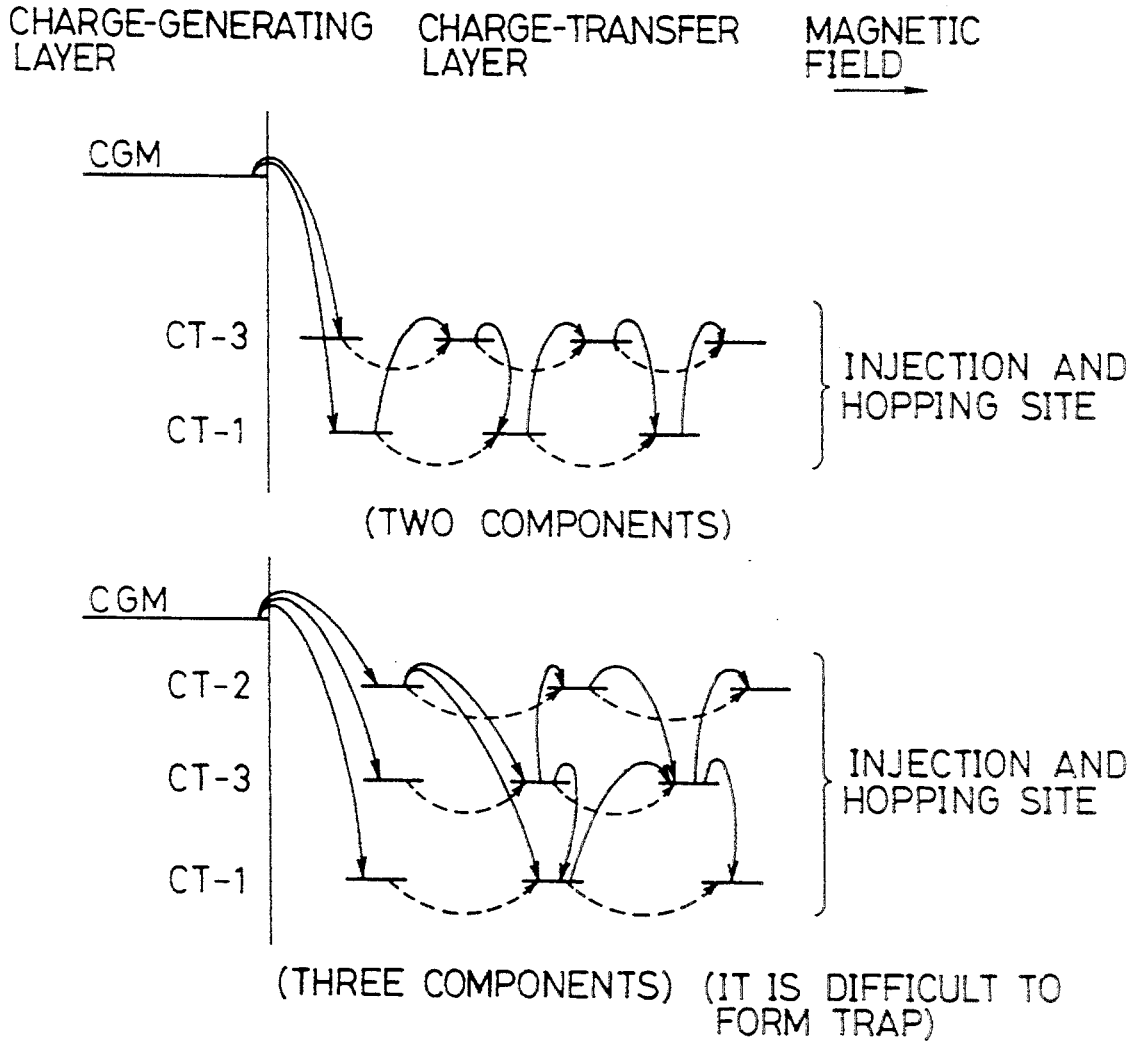
FIG. 2 is a diagram showing a model for explaining charge-transfer mechanism in a two-component system according to this invention.
Figure 3:
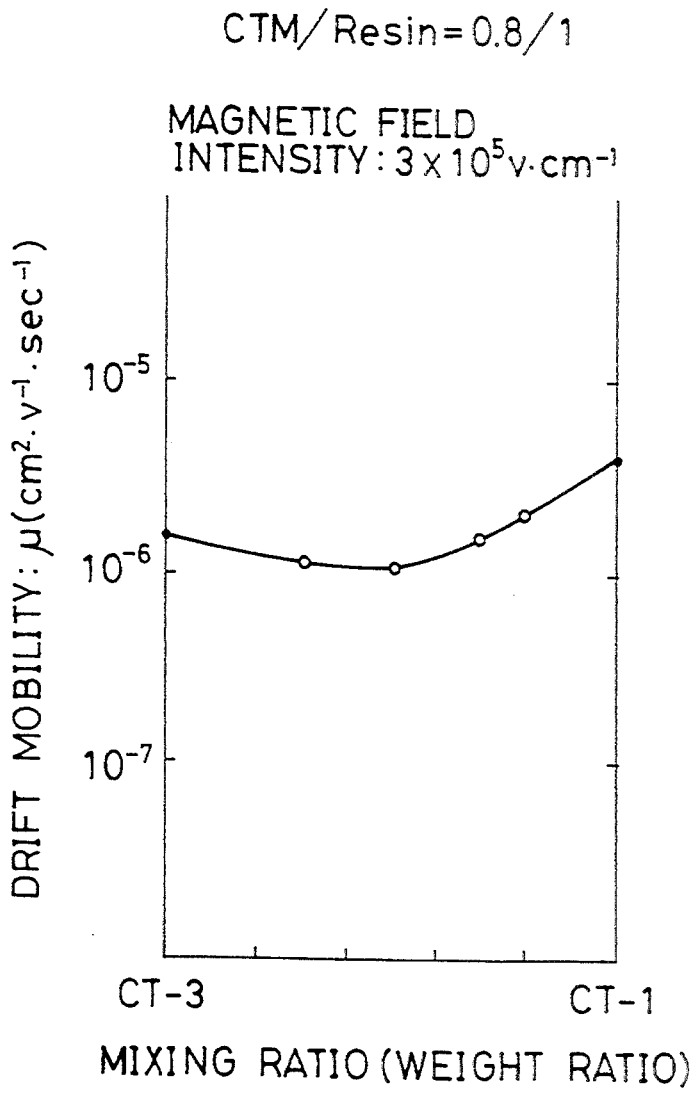
FIG. 3 is a graph showing drift mobility of electrophotographic photoreceptors, which were obtained in Example 1 of this invention, to mixing ratio.

In the two-component system, a photoreceptor comprising a charge-transfer layer having small difference in oxidation potential between the two components does not exhibit sharp reduction in drift mobility which is considered to be caused due to trap, as shown in FIG. 3. In addition, it does not exhibit reduction in the drift mobility corresponding to change in the density of each component. It is believed that this is due to relatively free transfer of the carrier caused between conductive levels in the components when the levels come close to each other (FIG. 2).

Furthermore, in the two-component system having large difference in the oxidation potential between the components, the photoresponse characteristics are improved when part of the charge-transfer materials in the system is replaced with a third component having intermediate oxidation potential without changing the density of the charge-transfer materials in the system. In addition, the photoresponse characteristics are remarkably improved even when part of the charge-transfer material having high mobility and low oxidation potential is replaced with a material having high oxidation potential with difference of 0.1 V or less and low mobility. Furthermore, dependence of electric characteristics on temperature and humidity is also remarkably improved. These improvements could not be quite foreseen from the prior art and could be estimated to be new.

It is believed that these phenomena occur due to the matters that the carriers injected into the charge-transfer layer are not only transferred to low level in the course of conduction but also are relatively freely exchanged each other between the close conductive levels. Therefore, it is believed that the levels contributing to the conduction of the carriers become apparently wider and thus the temperature dependence is improved.

In order to easily transfer the carrier, it is necessary that the conductive levels are close to each other, i.e. that the difference in oxidation potential falls within a given range. The upper limit of the difference in oxidation potential is measured to be of the order of about 0.1 V (Values of the oxidation potential include ordinary tolerance). The lower limit thereof is not particularly limited and is determined to be inside the sensitivity limit of measurement by ordinary technique, for instance, to be about 0.001 V.

Furthermore, the charge transfer in the charge-transfer layer is performed between molecules and a geometric state between the molecules is related to easy transfer of the carrier. In order to more effectively transfer the carrier, it is preferred that stacking of the molecules is easily made between different molecules and the molecules are closely arranged so that they easily interact or are closely related with each other. To this end, it is preferred that structures of these molecules are similar to each other. The molecules having the similar structure include, for instance, various derivatives and substitution compounds having similar chemical structure and in addition molecules having similar planar structure.

The charge-transfer material according to this invention is conveniently selected from known charge-transfer materials which include, for instance, low-molecular compounds such as hydrazone, styryl, butadiene, pyrazoline, triphenylamine, benzidine, oxazole and oxadiazole series compounds or the like and further high-molecular compounds such as polyvinyl carbazole, epoxypropyl carbazole and polysilylene or the like.

As for resin used in forming the charge-transfer layer by coating according to this invention, there can be used, for instance, an insulative resin such as silicone resin, ketone resin, polymethyl methacrylate, polyvinyl chloride, acrylic resin, allyl resin, polyester, polycarbonate, polystyrene, acrylonitrile-styrene copolymer, acrylonitrile-butadiene copolymer, butyral resin (polyvinyl butyral), polyvinyl formal, polysulfone, polyacrylamide, polyamide, chlorinated rubber or the like, or an organic photoconductive polymer such as polyvinyl anthracene, polyvinyl pyrene or the like. The above-mentioned resins may be used alone or in combination. A solvent in which the resin is dissolved is selected depending on a kind of the resin. The solvent includes, for instance, alcohols such as methanol, ethanol or the like; aromatic hydrocarbons such as benzene, xylene, dichlorobenzene or the like; ketones such as acetone, methylethylketone or the like; esters such as acetate, methyl cellosolve or the like; aliphatic halogenated hydrocarbons such as chloroform, dichloromethane, dichloroethane, carbon tetrachloride or the like; ethers such as tetrahydrofuran, dioxane or the like; amides such as N,N-dimethylformamide, N,N-dimethylacetamide or the like; and sulfoxides such as dimethyl sulfoxide.

A coating film for forming the charge-transfer layer is applied by using a device such as spin coater, applicator, spray coater, bar coater, dip coater, doctor blade, roller coater, curtain coater, bead coater or the like. The film is dried at temperatures ranging from about 30° to 160° C., preferably about 60° to 120° C. for about 30 to 90 minutes. After drying, the film is about 5 to 40 micrometers thick, preferably about 10 to 20 thick.

Furthermore, plasticizers may be used with the resin according to need.

Incidentally, various additives, such as ultraviolet light absorber, a material for absorbing electrons or the like, which can be ordinarily used in the art, may be added to the charge-transfer layer according to need.

Materials for use in the charge-generating layer according to this invention may be selected from known photoconductive materials, for instance, charge-generating materials which include an inorganic material such as CdS, Se, ZnO or the like and an organic material such as a pigment or dye, for instance, azo pigment, indigo pigment, pyrylium pigment, thiapyrylium pigment, phthalocyanine pigment (e.g. titanyl phthalocyanine), perylene pigment, perynone pigment, polycyclic quinone pigment, squarylium compound, cyanine dye or the like.

The charge-generating layer may be formed by vacuum evaporation or coating.

Resin used in forming the charge-generating layer by coating according to this invention may be selected from various insulative resins and an organic photoconductive polymer such as polyvinyl anthracene, polyvinyl pyrene or the like. It is preferred to use insulative resins such as butyral resin (polyvinyl butyral), allyl resin, poloycarbonate, polyester, phenoxy resin, polyvinyl acetate, acrylic resin, polyacrylamide resin, polyvinyl pyridine, cellulose resin, urethane resin, epoxy resin, silicone resin, polystrene, polyketone, polyvinyl chloride, polyvinyl acetal, phenolic resin, melamine resin, casein, polyvinyl pyrrolidone or the like. Suitably, the charge-generating layer contains the resin of 90 wt. % or less, preferably 50 wt. % or less. The resin may be used alone or in combination. A solvent in which the resin is dissolved is selected depending on a kind of the resin. The solvent may be selected from the same solvents as used in forming the charge-transfer layer.

A coating film for forming the charge-generating layer is applied by the same device as used in forming of the charge-transfer layer as mentioned above. Drying of the film is performed at temperatures ranging from about 40° to 120° C., preferably about 60° to 80° C. for about 30 to 70 minutes. After drying, it is suitably that the film is about 0.01 to 5 micrometers thick, preferably about 0.1 to 1 micrometers thick.

Furthermore, plasticizers may be used with the resin according to need.

An undercoating layer may be applied onto the photoconductive supporting member such as a photoconductive substrate in order to improve adherence and level the substrate. Resin for use in the undercoating layer includes, for instance, alcohol-soluble polyamide resin such as nylon 6, nylon 66, nylon 11, nylon 610, copolymerized nylon, alkoxy methylated nylon or the like; casein; polyvinyl alcohol resin; nitrocellulose resin; ethylene-acrylic acid copolymer; gelatin; polyurethane resin; polyvinyl butyral resin, or the like. It is effective that conductive particles and/or plasticizer are contained in the resin. As for a solvent, there are used known solvents being capable of dissolving the above mentioned resins. The undercoating layer can be applied to the photoconductive substrate in the same manner as in forming of the charge-transfer layer and the charge-generating layer as mentioned above. It is suitably that the undercoating layer has a thickness of about 0.05 to 10 micrometers, preferably about 0.1 to 1 micrometers.

Furthermore, the electrophotographic photoreceptor according to this invention may be obtained by stacking the undercoating layer, the charge-generating layer and the charge-transfer layer in order on the photoconductive substrate, or stacking the undercoating layer, the charge-transfer layer and the charge-generating layer in order thereon, or applying; a dispersion of the charge-generating material and charge-transfer materials in suitable resin onto the undercoating layer. These undercoating layers may be omitted according to need.

Since there is very large difference in the conductive level between the butadiene series compound (CT-1) and hydrazone series compound (CT-2) that it was known to be used in combination, it is believed that the carrier transfer is performed without interacting in the charge-transfer layer. Therefore, by incorporating into the mixture another butadiene series compound (CT-3) having intermediate conductive level lain between the levels of the above both compounds (CT-1 and CT-2), the carrier transfer between the respective levels is relatively facilitated.

Furthermore, in the two-component system having large difference in the conductive level, if a third component having conductive level lain in the neighborhood of either level is added to the system, the characteristics in the resulting photoreceptor is effectively improved. Namely, by the addition of the third component, the level becomes apparently broad and thus the characteristics such as the mobility and the temperature dependence are improved.

In addition, these charge-transfer materials to be used are limited to the two components and it is possible to use even more components. Rather, in order to allow the charge to be injected from the charge-generating layer and efficiently conduct the charge, it is preferred that the difference in the conductive level between the two charge-transfer materials is not only increased but also many conductive levels having small difference in the conductive level are lain between the levels of the two materials, i.e. many materials having small difference in the oxidation potential are contained in the two-component system, so far as the resulting photoreceptor has the other practical characteristics.

This invention will be hereinafter described in more detail with reference to the following non-limitating working Examples and the effects practically achieved by this invention will also be discussed in detail in comparison with Comparative Example. In Examples, all parts are by weight, unless otherwise will be indicated and CT-X (X=1, 2, 3 and 4) indicates each compound in the following Table 1. In addition, the oxidation potential of each material was measured in a solution of perchloric acid-tetra-n-butylammonium as an electrolyte in acetonitrile or DMF (dimethylformamide).

TABLE 1

| CHARGE TRANSFER MATERIAL | CHARGE-TRANSFER MATERIAL STRUCTURAL FORMULA | OXIDATION POTENTIAL (V) |
|---|---|---|
| CT-1 | 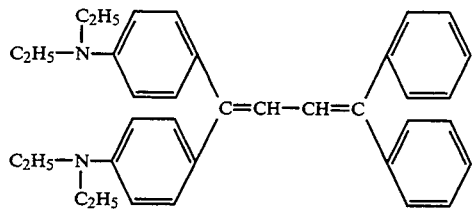 | 0.43 |
| CT-2 | 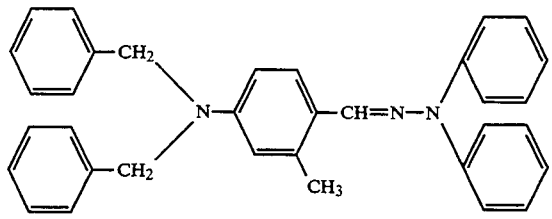 | 0.58 |
| CT-3 | 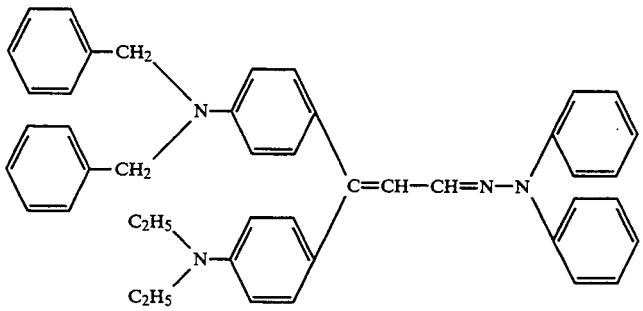 | 0.50 |
| CT-4 | 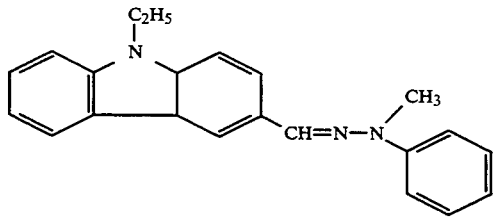 | 0.72 |

EXAMPLE 1

A film of titanyl phthalocyanine being 0.1 micrometers thick was deposited on an anodized aluminum substrate under a degree of vacuum of $10^{-5}$ Torrs to form a charge-generating layer. Then, a coating solution of 8 parts of a mixture of CT-1 and CT-3, in which the composition ratio was changed as shown in Tables 2 and 3, and 10 parts of a polycarbonate resin (Trade Name: Z-200, manufactured by MITSUBISHI GAS CHEMICAL COMPANY, INC.) in 160 parts of dichloromethane was applied onto the above-mentioned charge-generating layer to give a dry film 15 micrometers thick, i.e. a charge-transfer layer, thus fabricating electrophotographic photoreceptors having a stack type photosensitive layer.

Changes in drift mobility of these photoreceptors when changing half-value exposure ($E_{\frac{1}{2}}$) and magnetic field intensity thereof were measured by means of an electrostatic paper analyzer (Trade Name: EPA-8100, manufactured by Kawaguchi Electric Mfg. Ltd.). The drift mobility was determined by a so-called zerographic time-off-flight method. In addition, changes in residual potential when being repeatedly measured 1,000 times were determined (Tables 2 and 3). The results thus obtained on the drift mobility are plotted in FIG. 3, in which mixing ratio (weight ratio) is plotted in abscissa thereof and drift mobility is plotted in ordinate thereof.

TABLE 2

| CTM | COMPOSITION RATIO | INITIAL POTENTIAL CHARACTERISTICS $V_0$ (−V) | $V_0$ (−V) | $V_0$ (−V) | $DDR_3$ (%) | $E_{\frac{1}{2}}$ (Lux. sec) |
|---|---|---|---|---|---|---|
| CT-3 | 7/3 | 846 | 760 | 0 | 90.2 | 0.38 |
| | 5/5 | 789 | 703 | 0 | 89.6 | 0.34 |
| | 3/7 | 806 | 717 | 0 | 89.3 | 0.33 |
| CT-1 | 2/8 | 812 | 722 | 0 | 89.2 | 0.33 |
| CT-3 | 7/3 | 851 | 762 | 1 | 89.9 | 0.33 |
| | 5/5 | 811 | 724 | 3 | 89.4 | 0.34 |
| | 3/7 | 825 | 736 | 4 | 89.6 | 0.31 |
| CT-2 | 2/8 | 770 | 684 | 3 | 89.2 | 0.32 |

TABLE 3

| CTM | COMPOSITION RATIO | RUNNING CHARACTERISTICS $V_0$ (−V) 1K | $V_0$ (−V) INC | Vi (−V) 1K | Vi (−V) INC | Vr (−V) 1K | Vr (−V) INC | $DDR_{0.9}$ Aver | $E_{\frac{1}{2}}$ (L.s) Aver |
|---|---|---|---|---|---|---|---|---|---|
| CT-3 | 7/3 | 739 | 93 | 97 | 3 | 16 | −12 | 94.8 | 0.17 |
| | 5/5 | 691 | 101 | 65 | −3 | 10 | −10 | 94.2 | 0.16 |
| | 3/7 | 663 | 126 | 53 | 5 | 4 | 13 | 94.0 | 0.16 |
| CT-1 | 2/8 | 721 | 132 | 44 | 7 | 3 | −3 | 93.9 | 0.15 |
| CT-3 | 7/3 | 840 | 40 | 115 | −39 | 36 | −30 | 95.3 | 0.17 |
| | 5/5 | 788 | 23 | 99 | −46 | 42 | −37 | 94.9 | 0.17 |
| | 3/7 | 787 | 13 | 101 | −54 | 51 | −44 | 95.2 | 0.16 |
| CT-2 | 2/8 | 730 | 8 | 95 | −48 | 46 | −37 | 95.0 | 0.16 |

CTM: Charge transfer material
INC: Change in repeted use (increase) (2nd-1000th)
$V_0$: Surface potential
$E_{\frac{1}{2}}$: Half-value exposure
Vr: Residual potential
DDR: Dark decay ratio
RUNNING: Change in residual potential when being repeatedly measured 1000 times (2nd-1000th)

EXAMPLE 2

Figure 5:
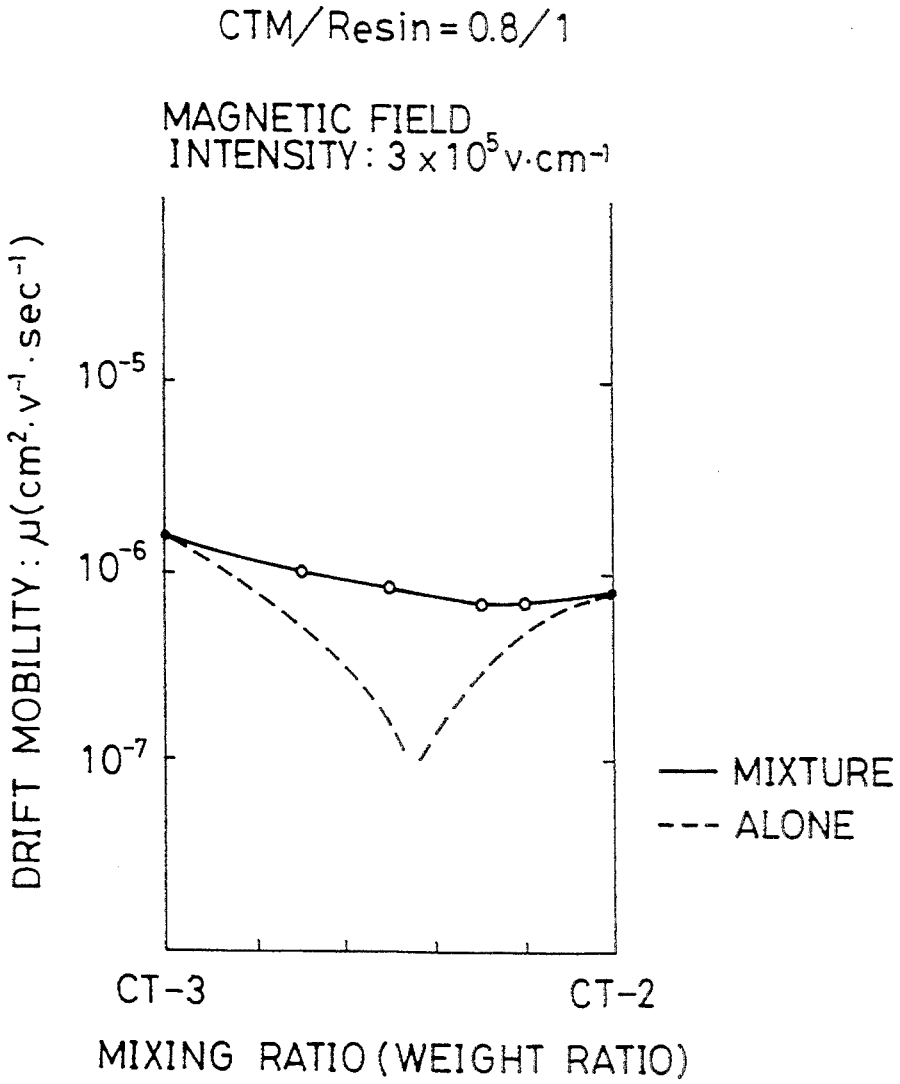
FIG. 5 is a graph showing drift mobility of electrophotographic photoreceptors, which were obtained in Example 4 of this invention, to mixing ratio.
Figure 11:
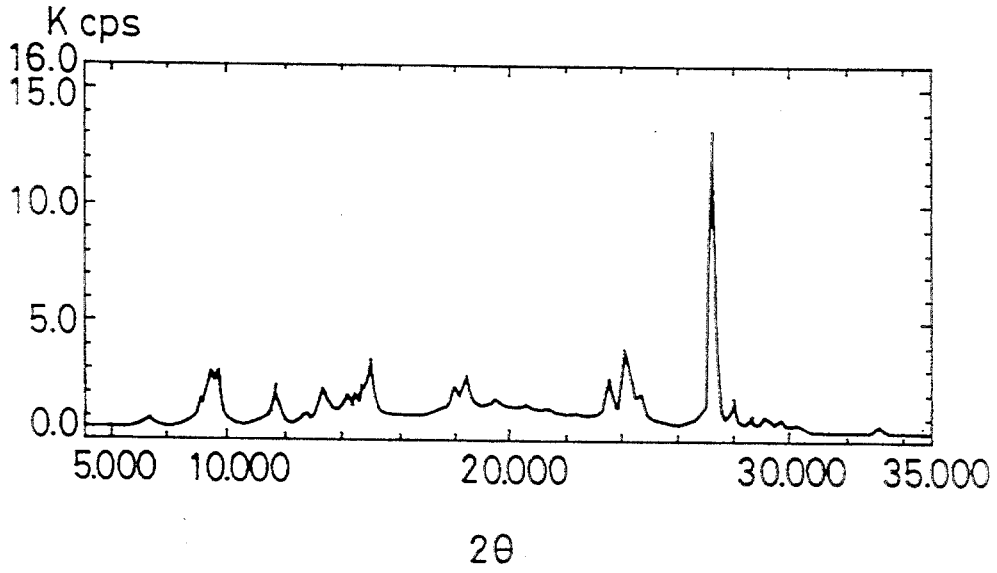
FIG. 11 shows an X-ray diffraction pattern on titanyl phthalocyanine used in Examples.

Nylon (Trade Name; T-8, manufactured by UNITIKA LTD.) was applied onto an aluminum substrate to give an undercoating layer having a dry film thickness of 0.5 micrometers. Then, a coating dispersion of 5 parts of titanyl phthalocyanine having an X-ray diffraction pattern as shown in FIG. 11 and 5 parts of a butyral resin in 90 parts of tetrahydrofuran was applied onto the above undercoating layer to give a charge-generating layer having a dry film thickness of 0.3 micrometers. Then, a coating solution of 10 parts of a mixture of CT-1 and CT-3, in which the composition ratio was changed as shown in Tables 4 and 5 (②, ④, ⑤ and ⑥), 1 part of CT-2 and 13 parts of a polycarbonate resin (Trade Name: Z-200, manufactured by MITSUBISHI GAS CHEMICAL COMPANY, INC.) in 160 parts of dichloromethane is applied onto the above-mentioned charge-generating layer to give a charge-transfer layer having a dry film thickness of 15 micrometers, thus electrophotographic photoreceptors having a stack type photosensitive layer being fabricated.

Figure 4:
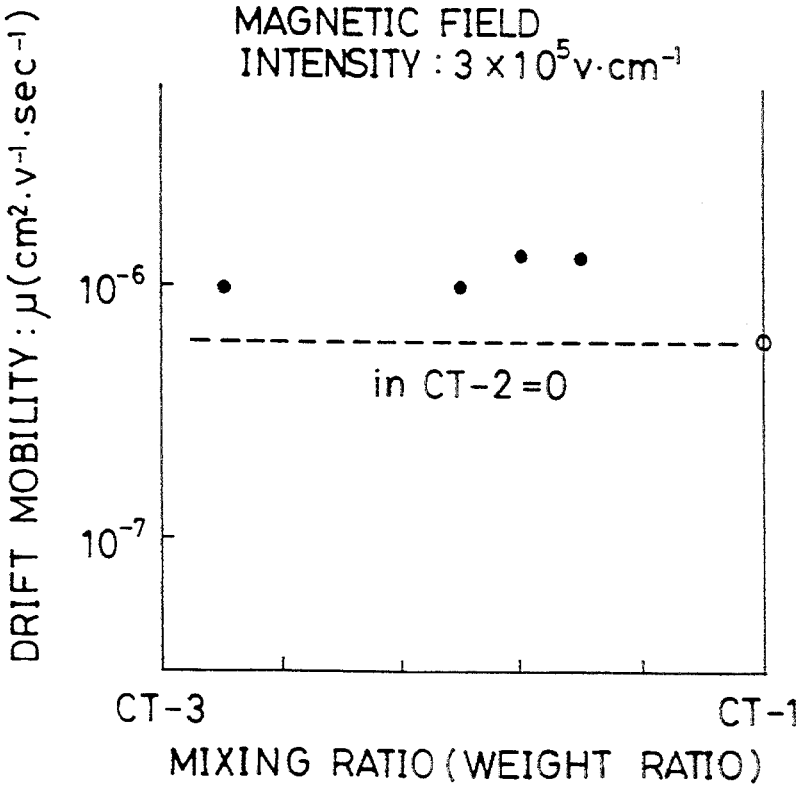
FIG. 4 is a graph showing drift mobility of electrophotographic photoreceptors, which were obtained in Example 2 of this invention, to mixing ratio.

Changes in drift mobility of the resulting photoreceptors when changing half-value exposure ($E_{178}$) and magnetic field intensity thereof were measured by means of the electrostatic paper analyzer (Trade Name: EPA-8100, manufactured by Kawaguchi Electric Mfg. Ltd.) in the same manner as in Example 1. In addition, changes in residual potential when being repeatedly measured 1,000 times were determined (Tables 4 and 5). The results thus obtained on the drift mobility are plotted in FIG. 4, in which mixing ratio (weight ratio) is plotted in abscissa thereof and drift mobility [$\mu$(cm$^2$ V$^{-1}$ sec$^{-1}$] is plotted in ordinate thereof.

TABLE 4

| CT-3/1/2 | INITIAL POTENTIAL CHARACTERISTICS $V_0$ (−V) | $V_3$ (−V) | $V_8$ (−V) | $DDR_3$ (%) | $E_{\frac{1}{2}}$ (Lux. sec.) |
|---|---|---|---|---|---|
| ① 4/6/0 | 817 | 692 | 0 | 85.1 | 0.32 |
| ② 4/6/1 | 812 | 690 | 0 | 85.4 | 0.32 |
| ③ 4/6/2 | 830 | 708 | 0 | 85.5 | 0.32 |
| ④ 3/7/1 | 827 | 706 | 0 | 85.6 | 0.32 |
| ⑤ 5/5/1 | 836 | 717 | 0 | 86.2 | 0.33 |
| ⑥ 9/1/1 | 835 | 719 | 0 | 86.6 | 0.34 |

TABLE 5

| CT-3/1/2 | RUNNING CHARACTERISTICS $V_0$ (−V) 1K | $V_0$ (−V) INC | Vi (−V) 1K | Vi (−V) INC | Vr (−V) 1K | Vr (−V) INC | $DDR_{0.9}$ Aver | $E_{\frac{1}{2}}$ (L. s) Aver |
|---|---|---|---|---|---|---|---|---|
| ① 4/6/0 | 732 | 100 | 61 | 3 | 7 | −4 | 94.2 | 0.16 |
| ② 4/6/1 | 739 | 65 | 66 | −6 | 9 | −6 | 94.2 | 0.16 |
| ③ 4/6/2 | 765 | 59 | 72 | −11 | 13 | −9 | 94.3 | 0.16 |
| ④ 3/7/1 | 733 | 81 | 59 | −4 | 7 | −5 | 94.1 | 0.16 |

TABLE 5-continued

| | RUNNING CHARACTERISTICS | | | | | | | |
|---|---|---|---|---|---|---|---|---|
| | $V_0$ (−V) | | Vi (−V) | | Vr (−V) | | $DDR_{0.9}$ | $E_{\frac{1}{2}}$ (L. s) |
| CT-3/1/2 | 1K | INC | 1K | INC | 1K | INC | Aver | Aver |
| ⑤ 5/5/1 | 775 | 53 | 76 | −14 | 13 | −10 | 94.4 | 0.16 |
| ⑥ 9/1/1 | 794 | 33 | 91 | −23 | 21 | −16 | 94.7 | 0.17 |

Figure 8:
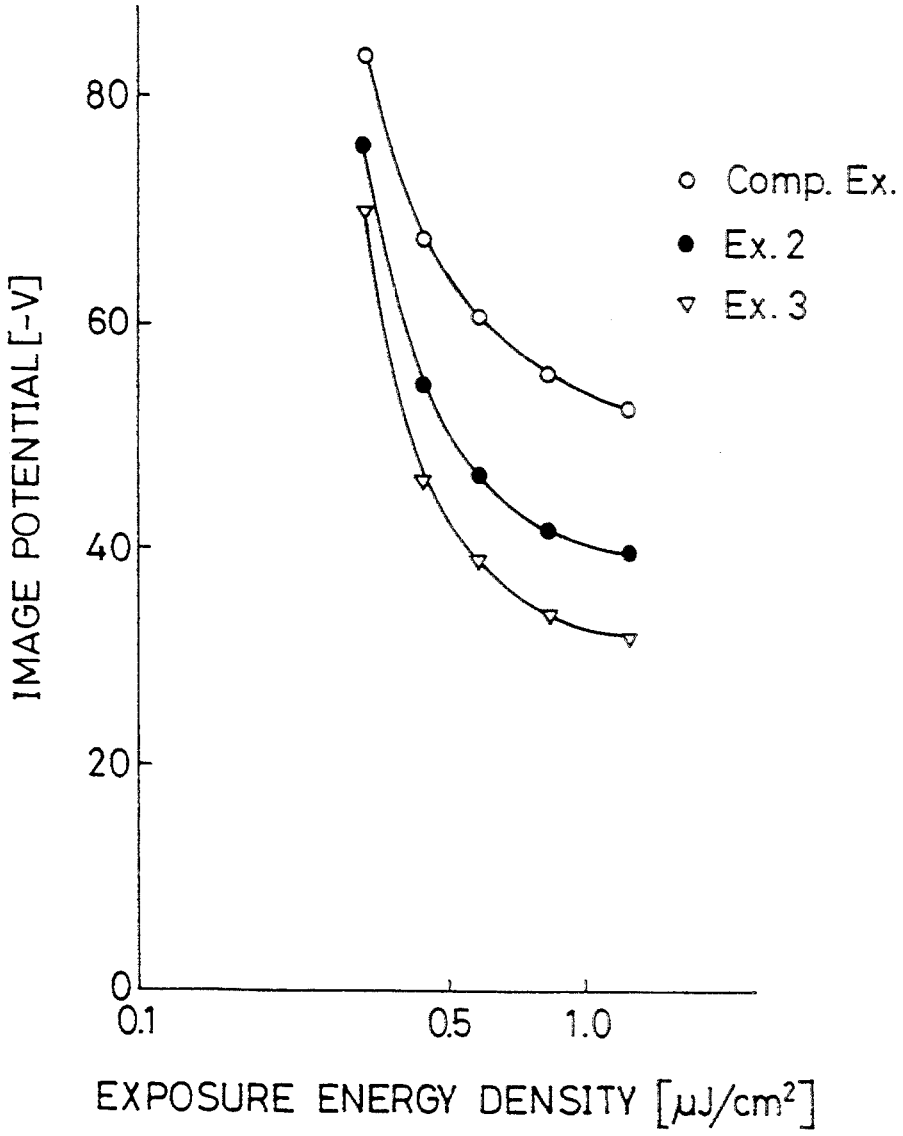
FIG. 8 is a graph showing exposure characteristics of electrophotographic photoreceptors obtained in Examples 2 and 3 and Comparative Example of this invention.
Figure 9:
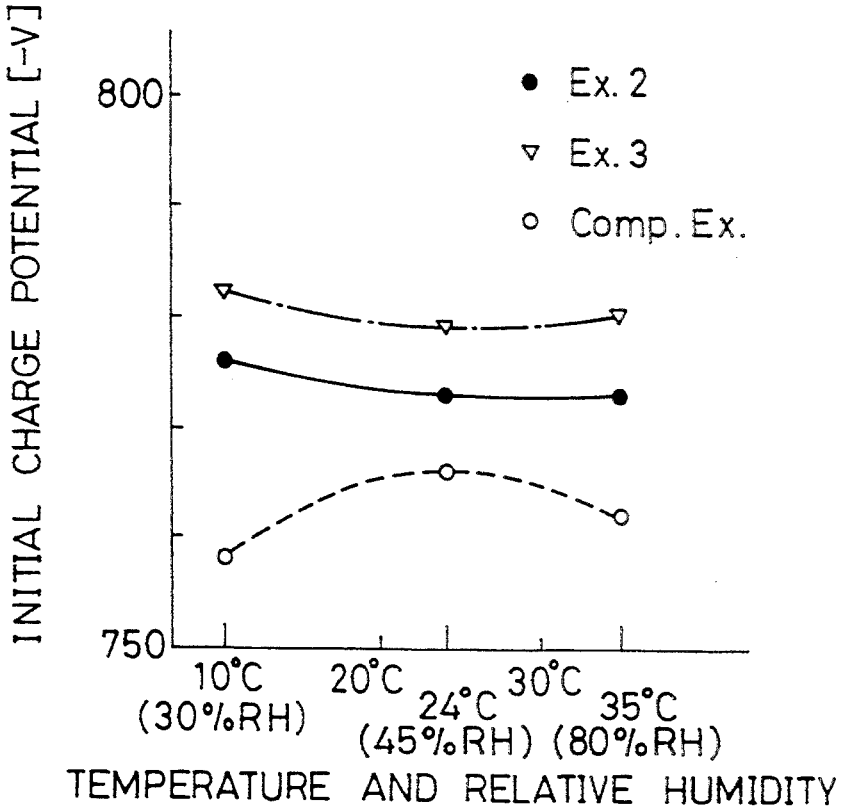
FIG. 9 is a graph showing charge potential-temperature and humidity characteristics of electrophotographic photoreceptors obtained in Examples 2 and 3 and Comparative Example of this invention.
Figure 10:
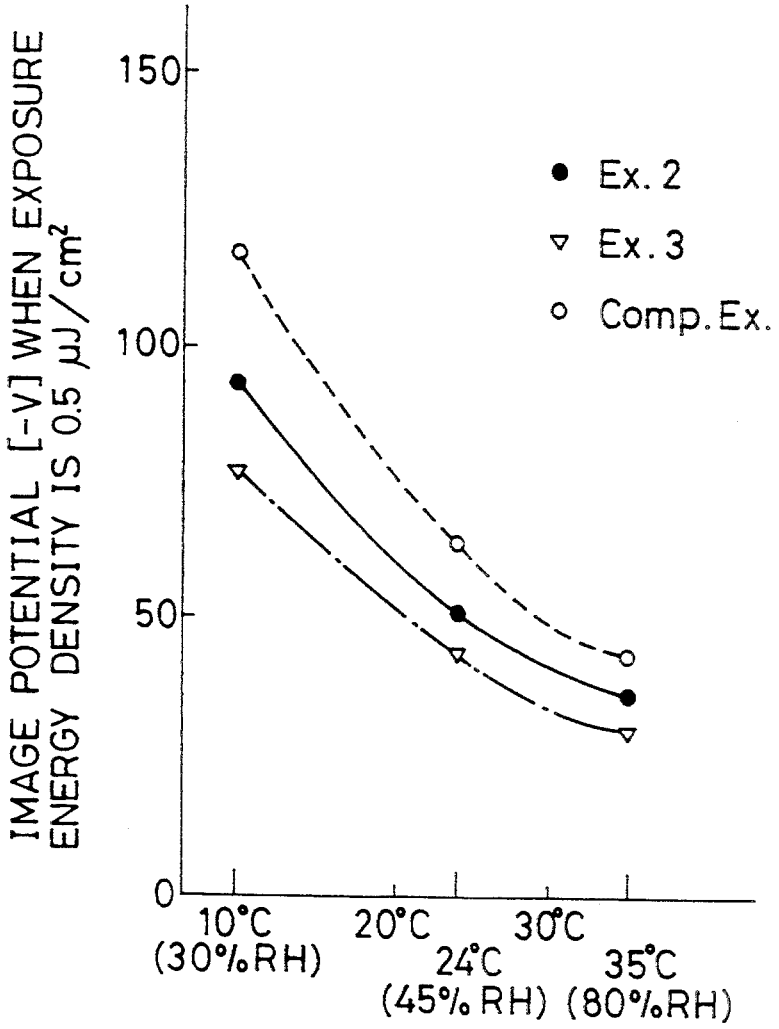
FIG. 10 is a graph showing image potential-temperature and humidity characteristics of electrophotographic photoreceptors obtained in Examples 2 and 3 and Comparative Example of this invention.

With respect to photoresponse characteristics, change in potential when being irradiated with pulse beams from a diode laser of 3 mW (780 nm) for 10 microseconds was measured (FIGS. 8, 9 and 10). In FIG. 8 showing exposure characteristics (normal temperatures and humidity) of the photoreceptor (②: CT-3/1/2=4/6/1) of this Example, exposure energy density ($\mu J/cm^2$) is plotted in abscissa thereof and image potential (−V) is plotted in ordinate thereof. In FIG. 9 showing charge potential-temperature and relative humidity characteristics of the photoreceptor (②: CT-3/1/2=4/6/1) of this Example, temperature (°C.) and relative humidity (%RH) are plotted in abscissa thereof and initial charge potential (−V) is plotted in ordinate thereof. In FIG. 10 showing image potential-temperature and relative humidity characteristics (energy density: 0.5 $\mu J/cm^2$) of the photoreceptor (②: CT-3/1/2=4/6/1) of this Example, temperature (°C.) and relative humidity (% RH) are plotted in abscissa thereof and image potential (−V) when exposure energy density is 0.5 $\mu J/cm^2$ is plotted in ordinate thereof. The photoreceptors obtained in this Example exhibited more excellent photoresponse characteristics than those in Comparative Example described below.

Example 3

Nylon (Trade Name; T-8, manufactured by UNITIKA LTD.) was applied onto an aluminum substrate to give an undercoating layer having a dry film thickness of 0.5 micrometers. Then, a coating dispersion of 5 parts of titanyl phthalocyanine having an X-ray diffraction pattern as shown in FIG. 11 and 5 parts of a butyral resin in 90 parts of tetrahydrofuran was applied onto the above undercoating layer to give a charge-generating layer having a dry film thickness of 0.3 micrometers. Then, a coating solution of 8 parts of a mixture of CT-1, CT-2, and CT-3, in which a ratio of CT-3/CT-1/CT-2 is 4/6/0, 1 or 2, and 10 parts of a polycarbonate resin (Trade Name: Z-200, manufactured by MITSUBISHI GAS CHEMICAL COMPANY, INC.) in 160 parts of dichloromethane was applied onto the above-mentioned charge-generating layer to give a charge-transfer layer having a dry film thickness of 15 micrometers, thus electrophotographic photoreceptors (①-③ of Tables 4 and 5) having a stack type photosensitive layer being fabricated.

Figure 6:
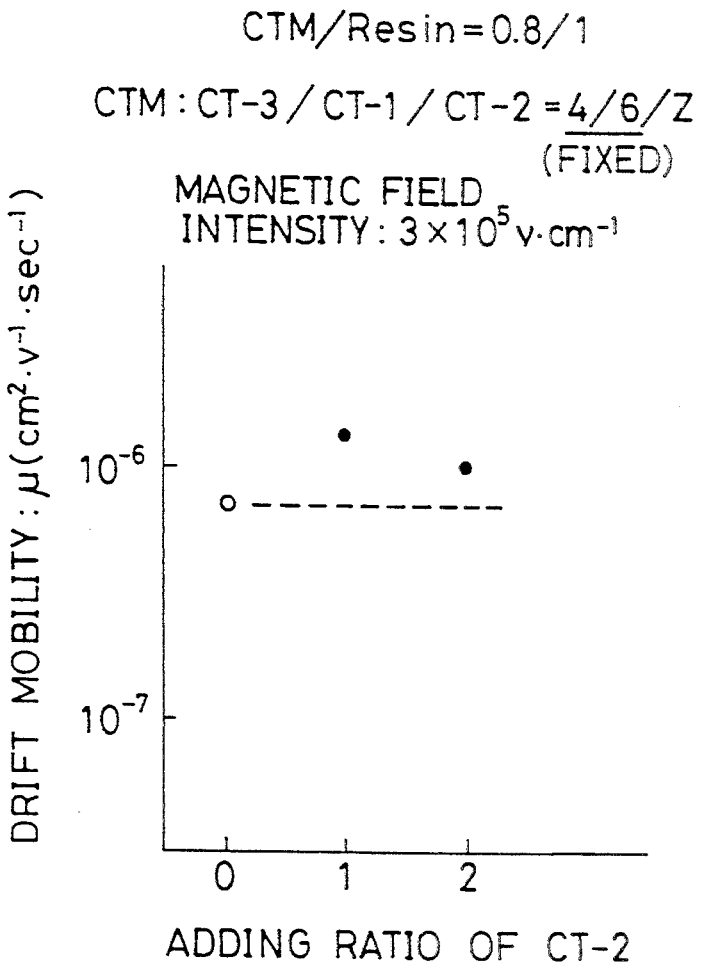
FIG. 6 is a graph showing drift mobility of electrophotographic photoreceptors, which were obtained in Example 3 of this invention, to mixing ratio.

Changes in drift mobility and potential of the resulting photoreceptors were measured in the same manner as in Example 2. The results thus obtained were plotted in FIGS. 6, 8, 9 and 10. In FIG. 6, ratio of CT-2 to be added is plotted in abscissa thereof and drift mobility is plotted in ordinate thereof. FIGS. 8 to 10 are the same as in Example 2. The photoreceptor obtained in this Example exhibited more excellent photoresponse characteristics than those in Comparative Example described below.

EXAMPLE 4

The same charge-generating layer as in Example 3 was formed on an anodized aluminum substrate and then a coating solution of 8 parts of a mixture of CT-2 and CT-3, in which the composition ratio was changed as shown in Tables 2 and 3, and 10 parts of a polycarbonate resin (Trade Name: Z-200, manufactured by MITSUBISHI GAS CHEMICAL COMPANY, INC.) in 180 parts of dichloromethane was applied onto the above-mentioned charge-generating layer to give a charge-transfer layer having a dry film thickness of 15 micrometers, thus electrophotographic photoreceptors being fabricated.

Changes in drift mobility and residual potential of the resulting photoreceptors were measured in the same manner as in the above-mentioned Examples (Tables 2 and 3). The results thus obtained on the drift mobility are plotted in FIG. 5, wherein mixing ratio (weight ratio) is plotted in abscissa thereof and drift mobility is plotted in ordinate thereof.

EXAMPLE 5

The same charge-generating layer as in Example 3 was formed on an anodized aluminum substrate and then a coating solution of 3 parts of CT-2, 3 parts of CT-3, 2 parts of CT-4 and 10 parts of a polycarbonate resin in 180 parts of dichloromethane was applied onto the above-mentioned charge-generating layer to give a charge-transfer layer having a dry film thickness of 15 micrometers, thus an electrophotographic photoreceptor being fabricated.

The above-mentioned procedures were repeated except that the charge-transfer layer was replaced with a layer including 5 parts of CT-3 and 3 parts of CT-4, to thus fabricate another photoreceptor in comparison to the above photoreceptor.

Values of drift mobility of the resulting photoreceptors were $8\times10^{-7}$ and $3\times10^{-7}$ ($cm^2$/ V.s), respectively.

EXAMPLE 6

The same charge-generating layer as in Example 3 was formed on an anodized aluminum substrate and then a coating solution of 2 parts of CT-1, 2 parts of CT-2, 2 parts of CT-3, 2 parts of CT-4 and 10 parts of a polycarbonate resin in 180 parts of dichloromethane was applied onto the above-mentioned charge-generating layer to give a charge-transfer layer having a dry film thickness of 15 micrometers, thus an electrophotographic photoreceptor being fabricated.

The above-mentioned procedures were repeated except that the charge-transfer layer was replaced with a layer comprising 4 parts of CT-1 and 4 parts of CT-4, to thus fabricate another photoreceptor in comparison to the above photoreceptor.

Values of drift mobility of the resulting photoreceptors were $1.2\times10^{-6}$ and $6\times10^{-7}$ ($cm^2$/V.s), respectively.

Comparative Example

Figure 7:
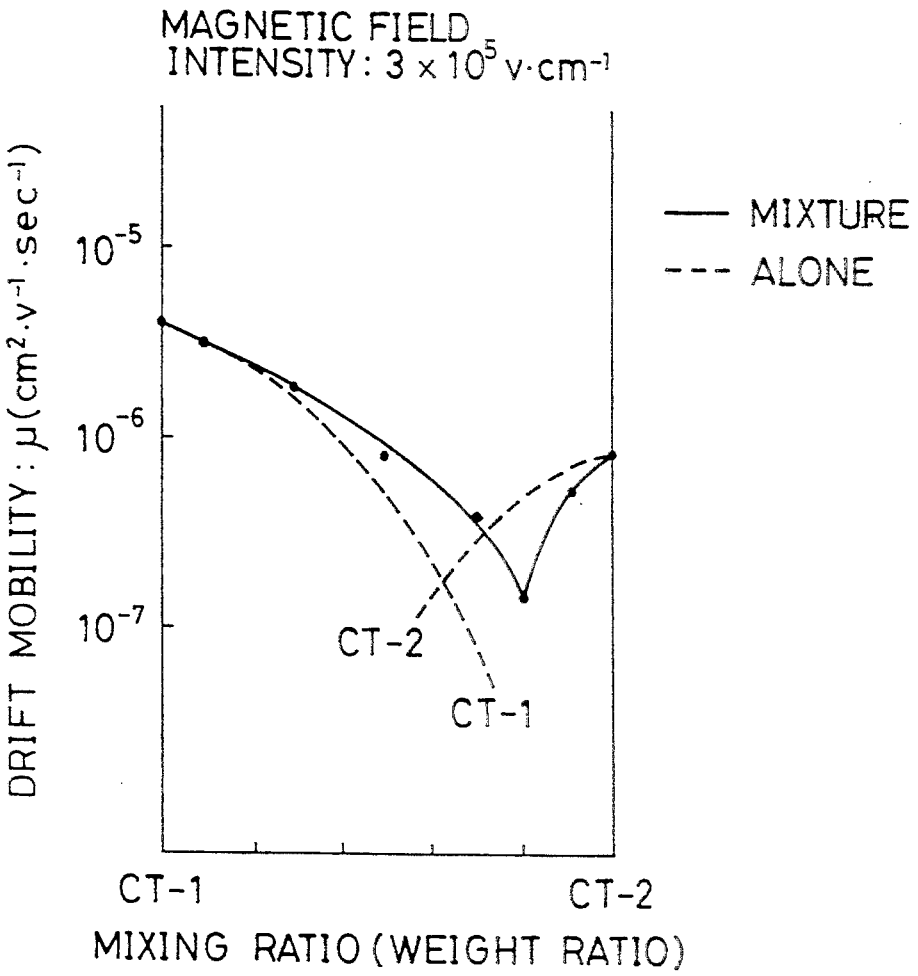
FIG. 7 is a graph showing drift mobility of electrophotographic photoreceptors, which were obtained in Comparative Example of this invention, to mixing ratio.

An undercoating layer and a charge-generating layer were formed on an aluminum substrate in the same manner in Example 2 and then a coating solution of 8 parts of a mixture of CT-1 and CT-2, in which the composition ratio was changed as shown in FIG. 7 (i.e. CT-1/CT-2=1/9, 3/7, 5/5, 7/3 and 9/1), and 10 parts of a polycarbonate resin (Trade Name: Z-200, manufactured by MITSUBISHI GAS CHEMICAL COMPANY, INC.) in 180 parts of dichloromethane was applied onto the above-mentioned charge-generating layer to give a charge-transfer layer having a dry film thickness of 15 micrometers, thus electrophotographic photoreceptors being fabricated.

Changes in drift mobility of the resulting photoreceptors to the mixing ratio were measured in the same manner as in the above-mentioned Examples and the results thus obtained are plotted in FIG. 7, wherein mixing ratio (weigh ratio) is plotted in abscissa thereof and drift mobility [$\mu(cm^2. V^{-1}. sec^{-1})$ is plotted in ordinate thereof. Changes in potential of the photoreceptors were measured in the same manner as in the above-mentioned Examples and the results thus obtained are plotted in FIGS. 8 to 10 as mentioned above.

As discussed above, according to this invention, the charge-transfer layer is made of two or more of different charge-transfer materials having oxidation potential getting close to each another, whereby it is possible to fabricate the electrophotographic photoreceptor which makes it possible to achieve excellent drift mobility without increasing the density of the charge-transfer material and which has good environmental resistance, is of much practical use and further has excellent characteristics.

While this invention has been described in connection with certain preferred embodiments, it is to be understood that the subject matter encompassed by way of this invention is not to be limited to those specific embodiments. On the contrary, it is intended for the subject matter of the invention to include all alternatives, modifications and equivalents as can be included within the spirit and scope of the following claims.

What is claimed is:

1. An electrophotographic photoreceptor comprising a comprising a photoconductive supporting member, a charge-generating layer and a charge-transfer layer, said charge-generating layer and said charge-transfer layer being disposed o said supporting member, in which said charge-transfer layer contains at least two charge-transfer materials, each of said at least two charge-transfer materials being selected from the group consisting of hydrazone, styryl, butadiene, pyrazoline, triphenylamine, benzidine, oxazole, oxadiazole series compounds, polyvinyl carbazole and epoxypropyl carbazole; and wherein a difference in oxidation potential between said charge-transfer materials is of 0.1 V or less.

2. The electrophotographic photoreceptor as defined in claim 1, wherein said photoconductive supporting member is an aluminum substrate.

3. The electrophotographic photoreceptor as defined in claim 1, wherein said photoconductive supporting member is an anodized aluminum substrate.

4. The electrophotographic photoreceptor as defined in claim 1, in which said charge-transfer materials further contain a compound represented by the following formula CT-4.

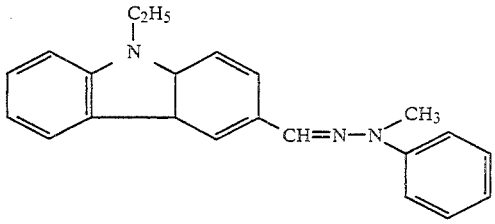

CT-4

5. The electrophotographic photoreceptor as defined in claim 1, wherein said charge-generating layer contains a material selected from the group consisting of inorganic materials such as CdS, Se and ZnO and organic materials such as azo pigment, indigo pigment, pyrylium pigment, thiapyrylium pigment:, phthalocyanine pigment, perylene pigment, perynone pigment, polycyclic quinone pigment, squarylium compound and cyanine dye.

6. The electrophotographic photoreceptor as defined in claim 1, wherein said charge-generating layer contains titanyl phthalocyanine.

7. The electrophotographic photoreceptor as defined in claim 1, wherein said photoconductive supporting member has an undercoating layer formed thereon.

8. The electrophotographic photoreceptor as defined in claim 7, wherein said undercoating layer contains a resin selected from the group consisting of alcohol-soluble polyamide resins such as nylon 6, nylon 66, nylon 11, nylon 610, copolymerized nylon and alkoxy methylated nylon; casein; polyvinyl alcohol resin; nitrocellulose resin; ethylene-acrylic acid copolymer; gelatin; polyurethane resin; polyvinyl butyral resin.

9. An electrophotographic photoreceptor comprising in order a photoconductive supporting member, a charge-generating layer and a charge-transfer layer, in which said charge-transfer layer contains at least two charge-transfer materials selected from the group consisting of low-molecular compounds such as hydrazone, styryl, butadiene, pyrazoline, triphenylamine, benzidine, oxazole and oxadiazole series compounds and high-molecular compounds such as polyvinyl carbazole, epoxypropyl carbazole and, difference in oxidation potential between said charge-transfer materials is of 0.1 V or less and said charge-generating layer contains a material selected from the group consisting of inorganic materials such as CdS, Se and ZnO and organic materials such as azo pigment, indigo pigment, pyrylium pigment, thiapyrylium pigment, phthalocyanine pigment, perylene pigment, perynone pigment, polycyclic quinone pigment, squarylium compound and cyanine dye.

10. The electrophotographic photoreceptor as defined in claim 9, wherein said photoconductive supporting member is an aluminum substrate.

11. The electrophotographic photoreceptor as defined in claim 9, wherein said photoconductive supporting member is an anodized aluminum substrate.

12. The electrophotographic photoreceptor as defined in claim 10, wherein said photoconductive supporting member has an undercoating layer formed thereon, said undercoating layer containing a resin selected from the group consisting of alcohol-soluble polyamide resins such as nylon 6, nylon 66, nylon 11, nylon 610, copolymerized nylon and alkoxy methylated nylon; casein; polyvinyl alcohol resin; nitrocellulose resin; ethylene-acrylic acid copolymer; gelatin; polyurethane resin; polyvinyl butyral resin.

13. An electrophotographic photoreceptor comprising, in order, a photoconductive supporting member, a charge-generating layer and a charge-transfer layer, in which said charge-transfer layer contains at least two charge-transfer materials selected from the group consisting of the following formulae CT-1, CT-2, and CT-3:

CT-1

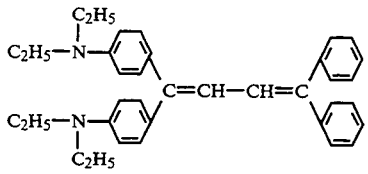

CT-2

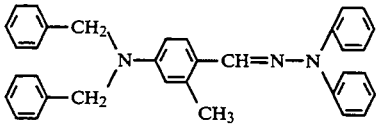

CT-3

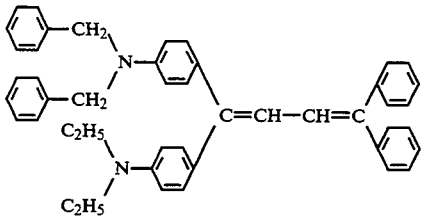

provided that a combination of said formulae CT-1 and CT-2 is excluded, and said charge-generating layer contains titanyl phthalocyanine.

14. The electrophotographic photoreceptor as defined claim 13, wherein said charge-transfer layer further contains a compound represented by the following formula CT-4.

CT-4

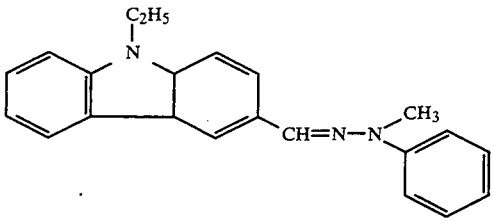

15. The electrophotographic photoreceptor as defined in claim 13, wherein said photoconductive supporting member has an undercoating layer formed thereon, said undercoating layer containing an alcohol-soluble polyamide resin.

16. An electrophotographic photoreceptor comprising a photoconductive supporting member, a charge-generating layer and a charge-transfer layer, said charge-generating layer and said charge-transfer layer being disposed on said supporting member, in which said charge-transfer layer contains at least two charge-transfer materials, each of said at least two charge-transfer compounds is selected from the group consisting of the following CT-1, CT-2 and CT-3:

CT-1

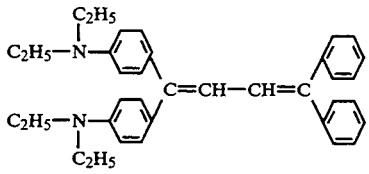

CT-2

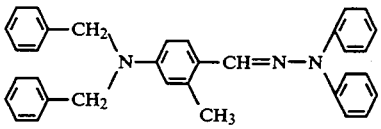

CT-3

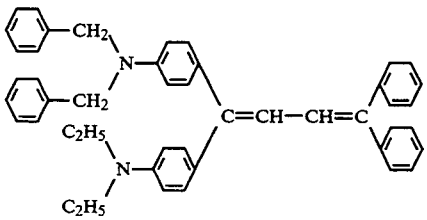

provided that a combination of said formulae CT-1 and CT-2 is excluded.

* * * * *